United States Patent [19]

Heston

[11] Patent Number: 4,801,057

[45] Date of Patent: Jan. 31, 1989

[54] CLOTHES HANGER

[76] Inventor: Krystyna L. Heston, 3611 NE. I St., Spc 52, Auburn, Wash. 98002

[21] Appl. No.: 30,354

[22] Filed: Mar. 26, 1987

[51] Int. Cl.[4] ..... A47G 25/44; A47G 25/14; A47G 25/36

[52] U.S. Cl. ..... 223/92; D6/319

[58] Field of Search ..... D6/317, 318, 319, 315; 223/88, 89, 94, 90, 91

[56] References Cited

U.S. PATENT DOCUMENTS

| | | | |
|---|---|---|---|
| D. 146,056 | 12/1946 | Levin | D6/318 |
| D. 157,040 | 1/1950 | Geisler | D6/319 |
| D. 242,320 | 11/1976 | Allen | D6/319 |
| D. 276,867 | 12/1984 | Arnold | D6/317 X |
| 2,531,108 | 11/1950 | Lasey | 223/89 |
| 2,637,471 | 5/1953 | Goldschmidt et al. | 223/89 |
| 2,724,533 | 11/1955 | Hansen | 223/94 |
| 2,817,470 | 12/1957 | Simon | 223/89 |
| 2,900,117 | 8/1959 | Veltry | 223/94 |
| 3,151,788 | 10/1964 | Wingate | 223/88 |

FOREIGN PATENT DOCUMENTS

| | | | |
|---|---|---|---|
| 542766 | 11/1955 | Belgium | 223/89 |
| 1390076 | 1/1965 | France | 223/94 |

*Primary Examiner*—Robert R. Mackey

*Attorney, Agent, or Firm*—Graybeal, Jensen & Puntigam

[57] ABSTRACT

The hanger includes a hook element (12) which extends upwardly from a neck element (13), Two shoulder elements (14, 16) extend downwardly at an angle from the neck element (13). The lower ends of the shoulder elements are connected by a divided crossbar (18). Extending outwardly from the ends of the crossbar (18) are shelf-like extensions (20,22) which are movable into and out of the ends of the crossbar (18).

3 Claims, 2 Drawing Sheets

16

30
31
18

22
30
31

31
30

20

24
20
13
13

12

14

13

38
40
16

14

16

CLOTHES HANGER

DESCRIPTION

1. Technical Field

This invention relates generally to the art of clothes hangers and more particularly concerns a clothes hanger with shelf-like extensions.

2. Background Art

Conventional wire clothes hangers, while economical because they typically are free, are generally disliked. In some cases, the use of such hangers in the home make people unconsciously nervous. Wire hangers can be returned to the dry cleaners, sterilized and used again, but typically they are just thrown away. Many attempts have been made to design a good, comfortable clothes hanger, but none of them have proven to be completely satisfactory. Accordingly, there is a continuing need for a clothes hanger which is comfortable to use and provides good support and stability for clothes. Also, there is a need for a hanger which is conveniently adjustable, for support of different clothes.

DISCLOSURE OF THE INVENTION

Accordingly, the present invention is a clothes hanger which includes two elongated shoulder elements joined together at the respective upper ends thereof by a neck element, in such a manner that the shoulder elements extend downwardly and at a substantial angle relative to each other. A hook element extends upwardly away from the neck element, and an elongated horizontal cross member extends between and is affixed to the respective lower ends of the shoulder elements. Two wing elements which are each relatively short compared to the length of the cross member are slidably mated with the cross member for movement in substantial registry with the cross member away from and into the respective ends of the cross member. The wing elements thereby define extensions of the cross member to provide an adjustable length capability for the hanger extending beyond the junction of said cross member and the shoulder elements. The relationship of the cross member and the shoulder elements is characterized by an absence of any connecting elements between the shoulder elements and the free end of the portion of each wing element which extends beyond the junction of said shoulder elements and said cross member, such that the extending portion of the wing elements form shelf-like extensions relative to the remainder of the hanger. The wing elements further include portions thereof which are arranged in such a fashion that they contact the shoulder elements when the wing elements have been extended a selected distance, tending to prevent further movement of the wing elements away from the ends of the cross member.

BEST MODE FOR CARRYING OUT THE INVENTION

Figure 1:
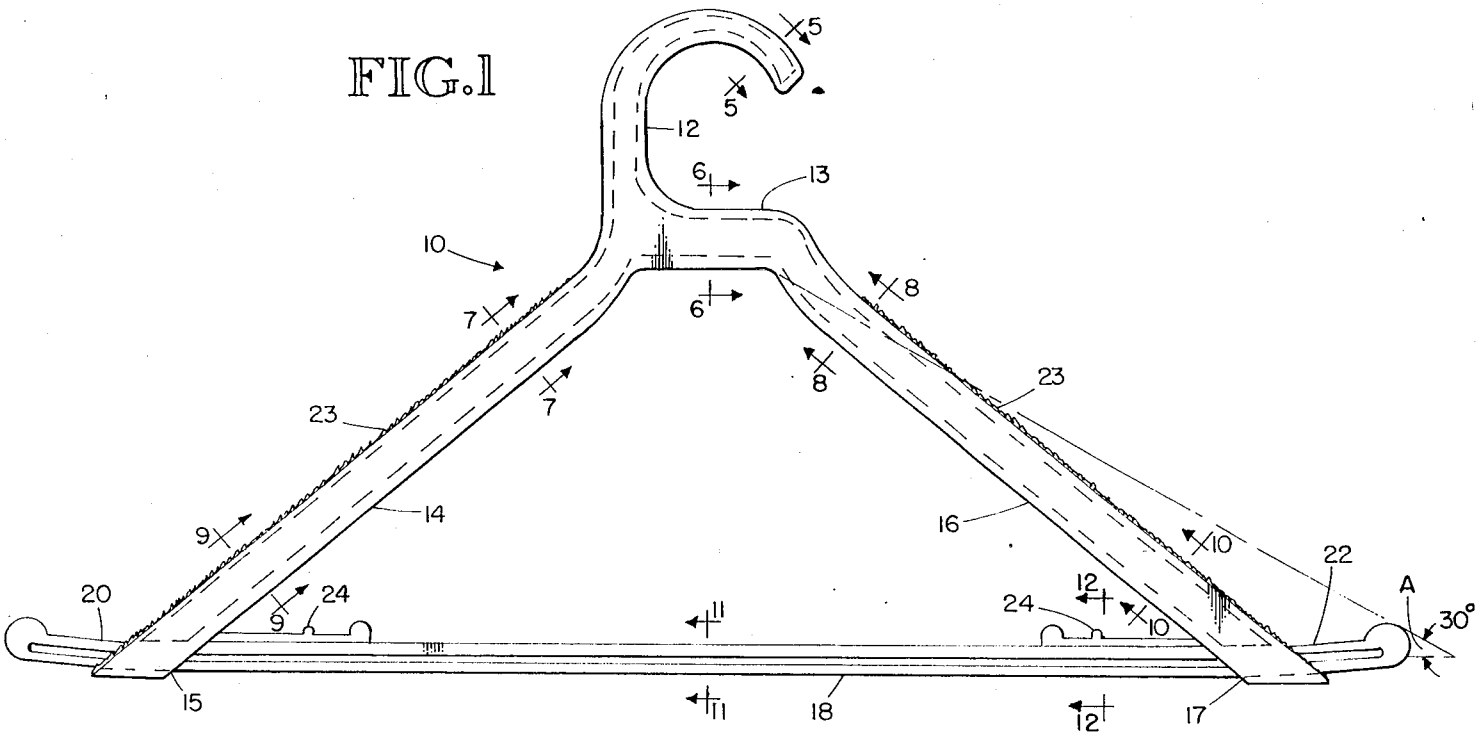
FIG. 1 is a front elevational view showing the clothes hanger of the present invention.
Figure 2:
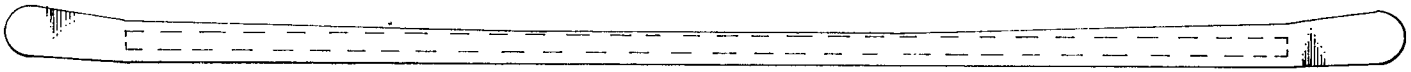
FIG. 2 is a top plan view of the clothes hanger of FIG. 1.

The clothes hanger shown generally at 10 in FIG. 1 has a hook element 12 for hanging it on the crossbar of a closet, a neck element 13 from which the hook element 12 extends, and two arms 14 and 16, also referred to as shoulder elements, which extend downwardly at an angle from the neck element 13. In the preferred embodiment, angle A is approximately 30°. Connecting the lower ends 15, 17 of the two arms 14 and 16 is a divided crossbar 18.

The hanger 10 is meant to support clothes which have a tendency to slide down from or glide off of the arms, i.e. shoulder elements, of conventional hangers. Extending from each end of the crossbar 18 are shelf-like extensions 20 and 22 which help to maintain clothes hanging on the hanger in a stable fashion. The shelf-like extensions 20 and 22 are adjustable in that they may be pulled out or pushed in relative to the ends of the crossbar 18. As can be seen from the drawings, the shelf-like extensions 20, 22 ride in the space between the two elements 30, 31 (FIG. 4) forming the divided crossbar 18. The upper surface of each shelf-like extension includes a small protrusions 24, which acts as a stop against the arms, i.e. the shoulder elements 14, 16 to prevent the shelf-like extensions 20, 22 from being pulled completely out from the crossbar 18. The upper surface 28 of each arm 14, 16 is scored at 23.

Figures 3, 4, 5, 6, 7, 8, 9, 10, 11, 12, 13, 14:
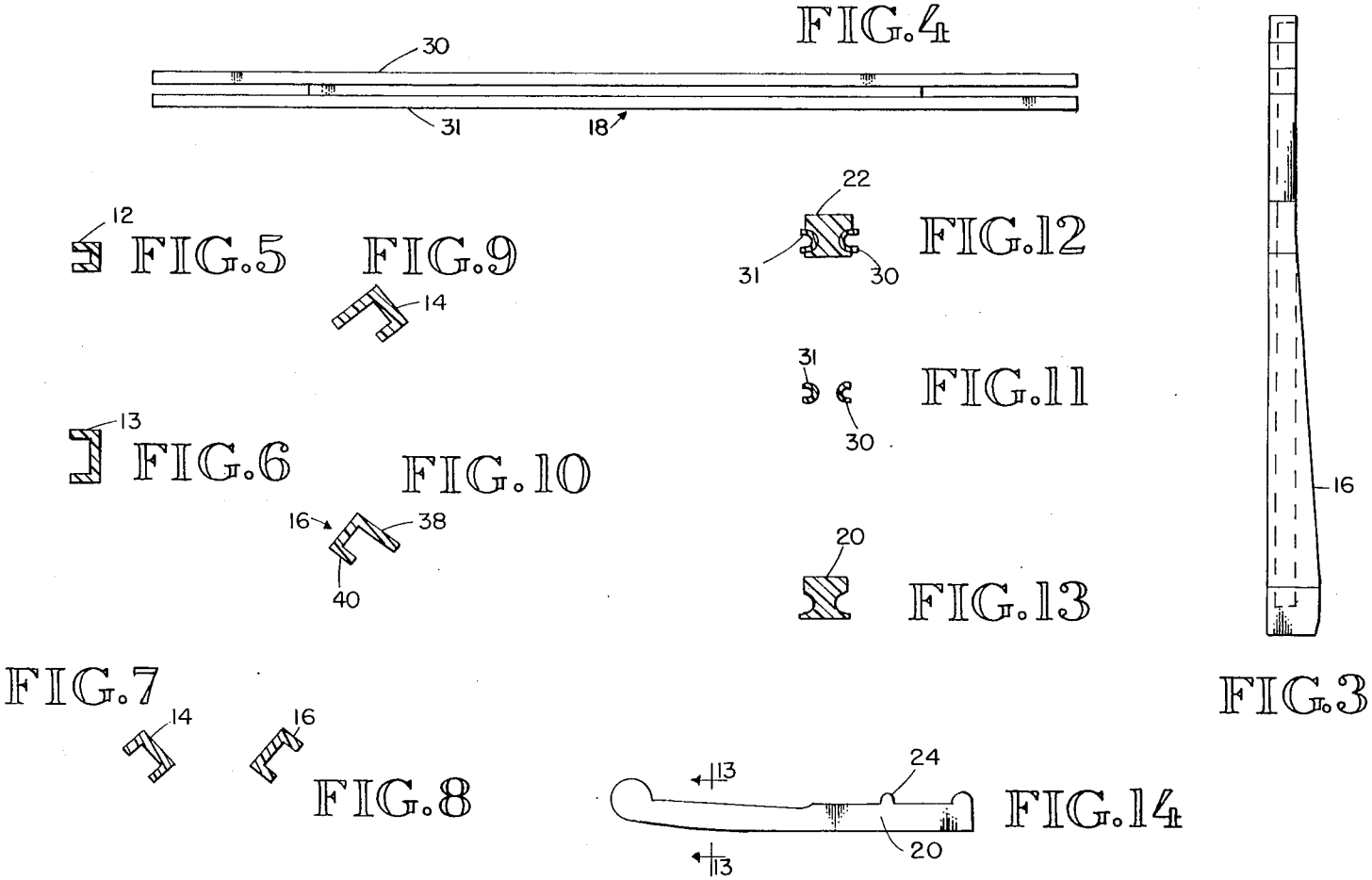
FIG. 3 is a side elevational view of the clothes hanger of FIG. 1.
FIG. 4 is a top plan view of the crossbar portion of the clothes hanger of FIG. 1.
FIG. 5 is a cross-section of a portion of the clothes hanger of FIG. 1 along lines 5—5.
FIG. 6 is a cross-section of a portion of the clothes hanger of FIG. 1 along lines 6—6.
FIG. 7 is a cross-section of a portion of the clothes hanger of FIG. 1 along lines 7—7.
FIG. 8 is a cross-section of a portion of the clothes hanger of FIG. 1 along lines 8—8.
FIG. 9 is a cross-section of a portion of the clothes hanger of FIG. 1 along lines 9—9.
FIG. 10 is a cross-section of a portion of the clothes hanger of FIG. 1 along lines 10—10.
FIG. 11 is a cross-section of a portion of the clothes hanger of FIG. 1 along lines 11—11.
FIG. 12 is a cross-section of a portion of FIG. 1 along lines 12—12.
FIG. 13 is a cross-section of a portion of the clothes hanger of FIG. 14 along lines 13—13.
FIG. 14 is a front elevational view of a shelf-like extension portion of the clothes hanger of FIG. 1.

While FIGS. 104 show the major portions of the hanger, FIGS. 5 through 14 show the details, including in particular the cross-sectional configuration, of various portions of the article. FIGS. 1–14 as a whole provide an accurate and complete disclosure of the hanger. In the embodiment shown, by way of dimensions, the total height of the hanger is $8\frac{5}{8}$ inches and the overall length is 18 inches, when the extensions 20, 22 are fully extended. The crossbar 18 is $12\frac{3}{4}$ inches long, approximately $\frac{3}{8}$ inch high and $\frac{1}{2}$ inch wide. The space between the two crossbar elements 30, 31 is approximately $\frac{1}{8}$th inch. Each element is shaped like a "C" in cross-section, arranged back-to-back as shown in FIG. 11 most clearly. The height from the lower edge of the neck element 13 to the top edge of the hook element 12 is approximately $3\frac{3}{8}$ inches. The width of the hook element is approximately $2\frac{1}{2}$ inches. The length of the shoulder elements 14, 16 in the embodiment shown is approximately 4 inches.

As can be seen in FIGS. 5–10, the hook element 12, the neck element 13 and the two shoulder elements 14, 16 are in the form of a square C in cross-section, although for shoulder elements 14, 16, as can be seen in FIGS. 3 and 7–10, the width of upper leg 38 (FIG. 10) of the C shaped shoulder element gradually increases, while the width of the lower leg 40 gradually decreases. FIG. 11 shows the cross-sectional configuration of the crossbar 18 and FIG. 13 shows the cross-sectional configuration of the shelf-like extensions 20, 22. The configuration of the shelf-like extensions 20, 22 mates with the configuration of the crossbar 18, as shown in FIG. 12. Such an arrangement permits a secure slidable arrangement between the shelf-like extensions 20, 22 and the crossbar 18.

The hangers may be made from plastic, preferably medium hard, in different colors. The hangers are easy to handle and it is easy to carry more than one at a time because of the C-shape of the cross-section of the hanger, which enables them to fit conveniently into, i.e. nest relative to, each other. The C-shape of the cross-section or profile of the hanger also makes it easy to recognize the respective front and back sides of the hanger, which assists in the hanging of clothes in the same direction in the closet.

The shape of the hook element 12 for hanging the hanger on a closet crossbar provides more flexibility in the use of the hanger, without the necessity of taking the hanger off the closet crossbar. It also provides more stability for the hanger while sliding the hangers on the crossbar. The hook element 12 does not turn, so that the hanger always remains in the same relative direction. Because of its construction and design, the hanger is neither too heavy nor too light.

The invention thus provides a convenient and comfortable clothes hanger. The divided crossbar and the adjustable shelf-like extensions which are slidably connected to the divided crossbar provide significant advantages not found in other hangers. The hangers provide comfort and order for home closets.

Although a preferred embodiment of the invention has been disclosed herein for illustration, it should be understood that various changes, modifications and substitutions may be incorporated in such embodiment without departing from the spirit of the invention as defined by the claims which follow.

I claim:

1. A garment hanger, comprising:

two elongated shoulder elements joined together at the respective upper ends thereof by a neck element such that said shoulder elements extend downwardly and at a substantial angle relative to each other;

a hook element extending upwardly away from said neck element;

an elongated, horizontal cross member extending between and affixed to the respective lower ends of said shoulder elements; and two wing elements which respectively are relatively short compared to the length of said cross member and which slidably mate with said cross member for movement in substantial registry with the cross member away from and into the respective ends of said cross member, thereby defining extensions of said cross member of adjustable length beyond the junction of said cross member and said shoulder elements, characterized by an absence of connecting elements between said shoulder elements and the free end of the portion of each wing element extending beyond the junction of said shoulder elements and said cross member to that the extending portion of said wing elements form shelf-like extensions relative to the remainder of the hanger, wherein the wing elements further include portions thereof which are arranged on the wing elements in such a fashion that they contact said shoulder elements, tending to prevent further movement of the wing elements away from the ends of the cross member, when the wing elements have been extended a selected distance.

2. The garment hanger of claim 1, wherein said cross member comprises two elongated rod-like elements spaced laterally apart from each other, separated by a relatively small distance, said rod-like elements having portions thereof which face each other, and wherein said wing elements, respectively, fit between said rod-like elements, the wing elements having a cross-sectional configuration which mate with the respective facing portions of the rod-like elements such that movement of the wing elements other than slidable movement away from and into the ends of the cross member is prevented, wherein said portions of the wing elements which tend to prevent further extending movement thereof are protrusions which extend from the upper surface thereof, and wherein the extending portion of each wing element terminates in a knob-like element which is larger in diameter than the remainder of the wing element.

3. The garment hanger of claim 2, wherein the facing portions of the rod-like elements are convex, and the surfaces of the wing elements mating therewith are concave.

* * * * *